US008256567B2

(12) United States Patent
Li et al.

(10) Patent No.: US 8,256,567 B2
(45) Date of Patent: Sep. 4, 2012

(54) DIAPHRAGM AND SPEAKER USING SAME

(75) Inventors: Lin-Zhen Li, Shenzhen (CN); Ji-Liang Lu, Shenzhen (CN); Wen-Tao Jiang, Shenzhen (CN)

(73) Assignees: AAC Acoustic Technologies (Shenzhen) Co., Ltd., Shenzhen (CN); AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 12/978,568

(22) Filed: Dec. 26, 2010

(65) Prior Publication Data

US 2012/0160597 A1 Jun. 28, 2012

(51) Int. Cl.
*G10K 13/00* (2006.01)

(52) U.S. Cl. ..... 181/157; 181/167; 181/170; 181/173

(58) Field of Classification Search ..... 181/157, 181/167, 170, 173
See application file for complete search history.

(56) References Cited

U.S. PATENT DOCUMENTS

| | | | | |
|---|---|---|---|---|
| 4,562,899 | A * | 1/1986 | Nakamura | 181/169 |
| 6,097,829 | A * | 8/2000 | Guenther et al. | 381/425 |
| 6,176,345 | B1 * | 1/2001 | Perkins et al. | 181/173 |
| 7,280,668 | B2 * | 10/2007 | Devantier et al. | 381/427 |
| 2004/0112672 | A1 * | 6/2004 | Ono et al. | 181/169 |
| 2010/0040246 | A1 * | 2/2010 | Windischberger et al. | 381/150 |
| 2010/0092011 | A1 * | 4/2010 | Windischberger et al. | 381/190 |
| 2011/0116677 | A1 * | 5/2011 | Wang et al. | 381/400 |
| 2011/0129113 | A1 * | 6/2011 | Kumakura et al. | 381/423 |

* cited by examiner

*Primary Examiner* — Forrest M Phillips
(74) *Attorney, Agent, or Firm* — IPro, Inc.; Na Xu

(57) ABSTRACT

A diaphragm is disclosed. The diaphragm includes a dome part, an edge part connected to an outer peripheral part of the dome part. The dome part includes a main body defining a first surface and a second surface opposite to the first surface, a first dome part connected to the first surface, and a second dome part connected to the second surface.

5 Claims, 2 Drawing Sheets

DIAPHRAGM AND SPEAKER USING SAME

BACKGROUND OF THE INVENTION

1. Field of the Invention

The present invention generally relates to the arts of speakers and more particularly to a diaphragm of a speaker.

2. Description of Related Art

In recent years, with the development of slim-type electronic devices such as liquid crystal display devices, mobile telephones, there is a demand for thin-type and slim-type speakers with high performance used in the electronic devices. Generally, such a speaker includes a diaphragm. The diaphragm is a very important element determining the performance of the speaker.

The diaphragm is typically formed from soft material by heat pressing. The soft material of the diaphragm can meet the requirement of low frequency, but at the same time affects the sound quality of high frequency. Therefore, it is difficult for a diaphragm made of single material to produce high quality sound. In order to overcome the defect mentioned above, diaphragms made of compound materials emerge because of the demand.

Generally, a compound diaphragm includes a membrane from a soft material and a dome part from a hard material overlapping the membrane.

In a related art, a compound diaphragm includes a dome part and a membrane part connected to an outer edge of the dome part. A thickness of the dome part is about 0.35 mm-0.45 mm. We need a thinner diaphragm to satisfy the demand for thin-type speakers with high performance. The thickness of the dome part determines the thickness of the whole diaphragm. A diaphragm with a dome part having an increased thickness can meet the performance requirement, however, at the same time increases the height of the speaker.

Therefore, it is necessary to provide a speaker with a diaphragm having enough thickness for meeting the requirement of performance and thin-type trend.

DETAILED DESCRIPTION OF THE EMBODIMENT

Reference will now be made to describe the exemplary embodiment of the present invention in detail.

Figure 1:
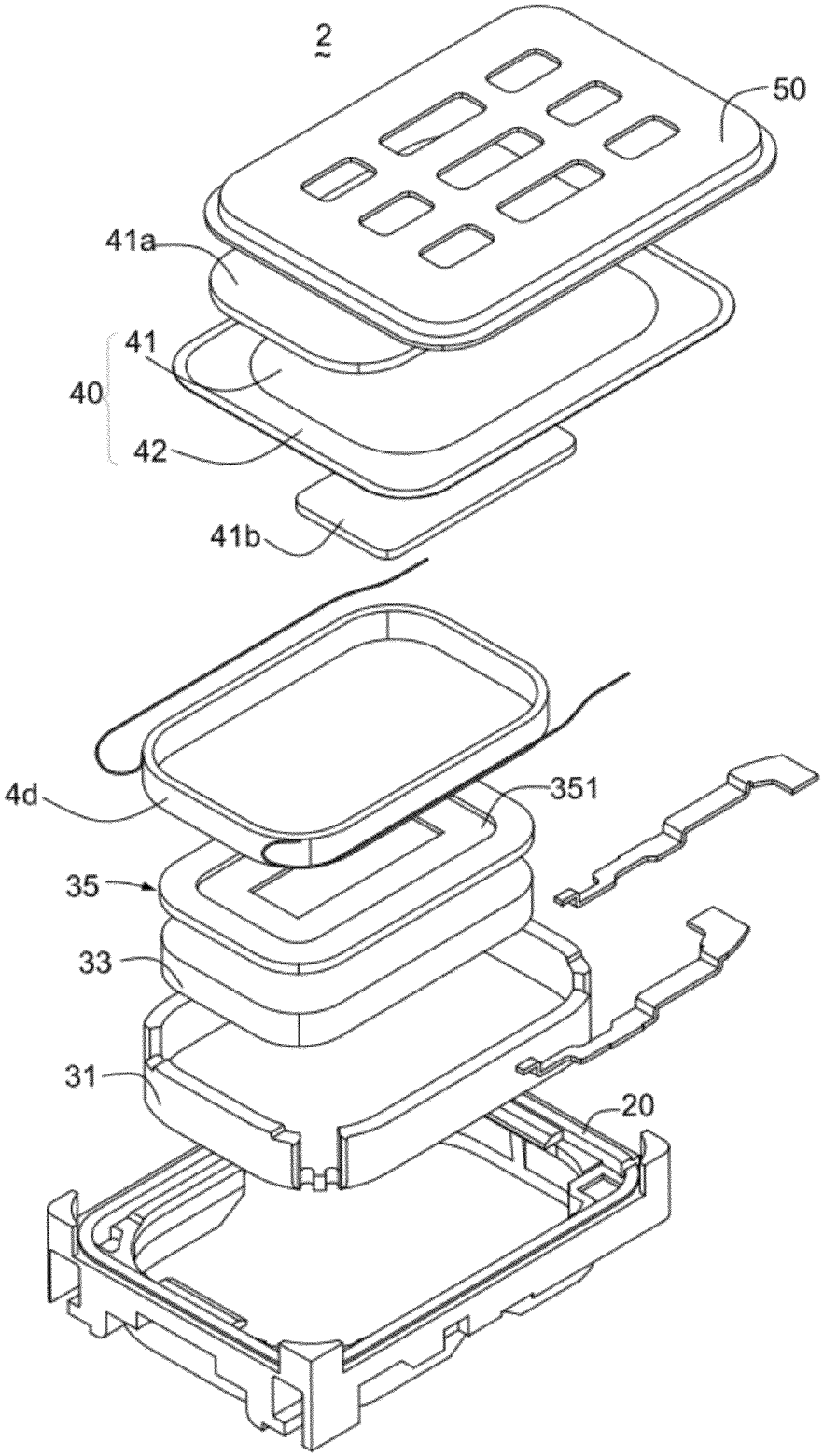
FIG. 1 is an exploded view of a speaker in accordance with an embodiment of the present invention.
Figure 2:
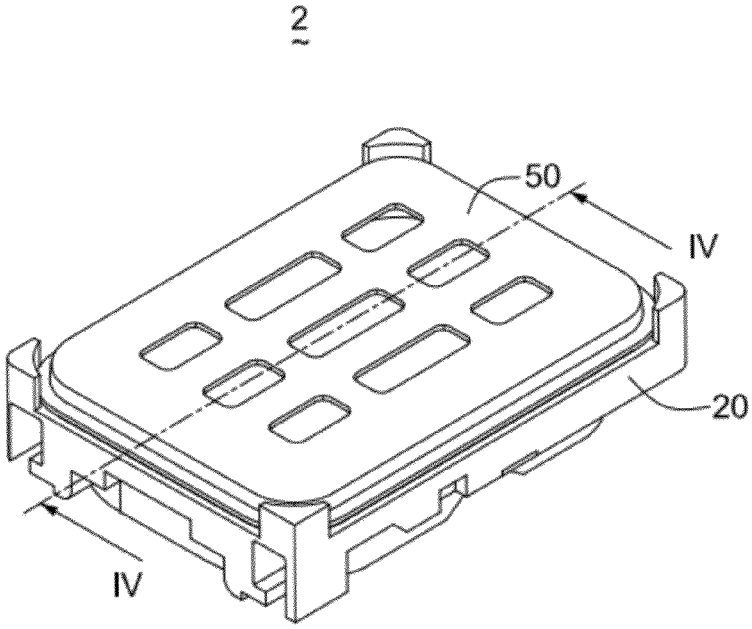
FIG. 2 is an isometric view of the speaker in FIG. 1.
Figure 3:
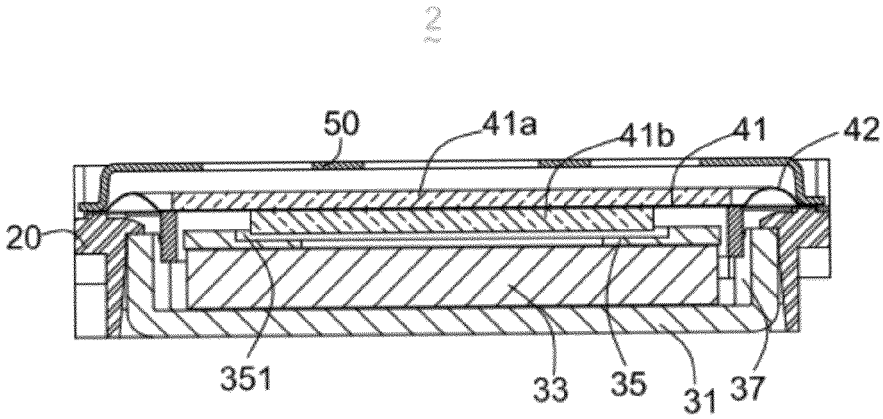
FIG. 3 is a cross-sectional view of the speaker along Line IV-IV in FIG. 2.

Referring to FIG. 1 to FIG. 3, a speaker 2 of an embodiment of the present invention comprises a case 20, a magnetic bowl 31 coupled to the case 20, a magnet 33 positioned in the magnetic bowl 31, a pole plate 35 covering the magnet 33, a magnetic gap 37 formed by the magnet 33 and the magnetic bowl 31, a diaphragm 40 supported by the case 20 and vibrating along a vibrating direction, a voice coil 4*d* connected to the diaphragm 40 and a cover 50 connected to the case 20. The pole plate 35 defines a cavity 351 in a middle portion thereof.

The diaphragm 40 comprises a dome part 41, an edge part 42 connected to an outer edge of the dome part 41, a first dome 41*a* positioned on an upper surface of the dome part 41, and a second dome 41*b* positioned on a lower surface of the dome part 41. Another word, the dome part 41 is sandwiched between the first dome 41*a* and the second dome 41*b*. A thickness of the first dome is 0.2-0.25 mm. In an optionally manner, the first dome 41*a* has a diameter substantially equal to a diameter of the voice coil 4*d*, and the cavity 351 of the pole plate 35 has a diameter greater than a diameter of the second dome 41*b* but smaller than the diameter of the first dome 41*a*.

While assembled, the second dome 41*b* is located between the dome part 41 and the pole plate 35, and the first part 41*a* is located above the dome part 41. During vibration, the second dome at least partially received in the cavity.

The diaphragm 40 has two dome parts, which improves the stiffness of the diaphragm and can meet the performance requirement. As a part of the combination of the first dome 41*a* and the second dome 41*b* is located in the space between the dome part 41 and the pole plate 35, the height of the speaker 2 will not be increased. In addition, the cavity 351 of the pole plate 35 can provide the second dome 41*b* with extra space to vibrate, which further decreases the height of the speaker 2.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A speaker comprising:

a case, a magnetic bowl coupled to the case;

a magnet positioned in the magnetic bowl;

a pole plate covering the magnet, the pole plate defining a cavity in a middle portion thereof;

a magnetic gap formed by the magnet and the magnetic bowl;

a diaphragm supported by the case and vibrating along a normal direction of the pole plate;

a voice coil connected to the diaphragm; wherein the diaphragm comprises an edge part connected and supported by the case, a dome part coupled to and surrounded by the edge part, a first dome located on an upper surface of the dome part, and a second dome located on a lower surface of the dome part, and the second dome is at least partially received in the cavity of the pole plate during vibration of the diaphragm.

2. A speaker comprising:

a case;

a magnetic bowl received in the case;

a magnet located on the magnetic bowl;

a pole plate covering on the magnet, the pole plate defining a cavity in a middle portion thereof;

a diaphragm supported by the case and facing the pole plate;

a voice coil for driving the diaphragm to vibrate along a normal direction of the pole plate;

a magnetic gap for partially receiving the voice coil; wherein the diaphragm further includes an edge part connected to and supported by the case, a dome part surrounded by the edge part and located in a middle portion of the diaphragm, a first dome attached to an upper surface of the dome part, and a second dome attached to a lower surface of the dome part and partially received in the cavity of the pole plate during vibration of the diaphragm.

3. The speaker as described in claim 2, wherein, the first dome has a diameter substantially equal to a diameter of the voice coil.

4. The speaker as described in claim 3, wherein, the second dome has a diameter smaller than the diameter of the first dome.

5. The speaker as described in claim 4, wherein, the cavity of the pole plate has a diameter greater than the diameter of the second dome but smaller than the diameter of the first dome.

* * * * *